US005196067A

United States Patent [19]

Lacchia

[11] Patent Number: 5,196,067

[45] Date of Patent: Mar. 23, 1993

[54] ELECTROSTATIC SPRAYING INSTALLATION FOR WATER-BASED PAINT

[75] Inventor: Adrien Lacchia, Grenoble, France

[73] Assignee: Sames S.A., Meylan, France

[21] Appl. No.: 735,706

[22] Filed: Jul. 26, 1991

Related U.S. Application Data

[63] Continuation of Ser. No. 494,547, Mar. 16, 1990, abandoned, which is a continuation of Ser. No. 113,269, Oct. 27, 1987, abandoned.

[30] Foreign Application Priority Data

Nov. 26, 1986 [FR] France ..... 86 16466

[51] Int. Cl.[5] ..... B05C 11/10; B05B 5/053

[52] U.S. Cl. ..... 118/694; 118/302; 118/630; 118/697

[58] Field of Search ..... 118/629, 630, 302, 634, 118/694, 697

[56] References Cited

U.S. PATENT DOCUMENTS

| | | | |
|---|---|---|---|
| Re. 32,151 | 5/1986 | Scharfenberger | 427/8 |
| 4,017,029 | 4/1977 | Walberg | 427/30 |
| 4,232,055 | 11/1980 | Shaffer | 427/33 |
| 4,275,834 | 6/1981 | Spanjersberg et al. | 239/3 |
| 4,311,724 | 1/1982 | Scharfenberger | 427/8 |
| 4,348,425 | 9/1982 | Scharfenberger | 427/8 |
| 4,350,720 | 9/1982 | Scharfenberger | 427/401 |
| 4,362,124 | 12/1982 | Fleig | 118/698 |
| 4,383,644 | 5/1983 | Spanjersberg et al. | 239/3 |
| 4,544,570 | 10/1985 | Plunkett et al. | 427/27 |
| 4,592,305 | 6/1986 | Scharfenberger | 118/677 |

FOREIGN PATENT DOCUMENTS

| | | |
|---|---|---|
| 882451 | 7/1980 | Belgium . |
| 3444703 | 3/1986 | Fed. Rep. of Germany . |
| 1574988 | 7/1969 | France . |
| 2414371 | 8/1979 | France . |
| 2454846 | 11/1980 | France . |
| 2498483 | 7/1982 | France . |
| 2572662 | 5/1986 | France . |
| 2166982 | 5/1986 | United Kingdom . |

*Primary Examiner*—Evan Lawrence
*Attorney, Agent, or Firm*—Sandler Greenblum & Bernstein

[57] ABSTRACT

An electrostatic spraying installation for low-resistivity paint comprises a conveyor which conveys large objects such as automobile bodies, to be painted with a substantially constant distance between their respective leading edges. A plurality of sprayers is positioned to paint respective specific parts of the objects as they are conveyed past the sprayers by the conveyor. A respective spray member in each sprayer is connected to a high-tension electrical supply. All the spray members are substantially situated in a common plane perpendicular to the path of movement of the objects along the conveyor or in a plurality of planes perpendicular to this path and spaced from each other by the previously mentioned substantially constant distance. A plurality of electrically grounded closed loop primary paint circulation circuits each contain paint of a respective color different than the color of the paint in each of the other primary circuits. A plurality of intermediate storage tanks electrically insulated from ground, equal in number to the primary circuits, are each assigned to a respective primary circuit. An arrangement for selectively connecting each intermediate storage tank to the respective primary circuit is provided and a plurality of selector valves connects each intermediate storage tank selectively to the sprayers. A control system operates the selective connection arrangement or a subset thereof only when none of the spray members is connected to the high-tension supply. Under this condition, the control system operates paint change units simultaneously when all the sprayers are facing the spaces between the objects.

7 Claims, 2 Drawing Sheets

ELECTROSTATIC SPRAYING INSTALLATION FOR WATER-BASED PAINT

This application is a continuation of application Ser. No. 07/494,547, filed Mar. 16, 1990, now abandoned, which is a continuation of application Ser. No. 07/113,269 filed Oct. 27, 1987, now abandoned.

BACKGROUND OF THE INVENTION

1. Field of the Invention

The invention concerns an electrostatic spraying installation, in particular one for a new type of paint, referred to herein as "water-based" paint, usable on automobile bodies and having low resistivity.

2. Description of the Prior Art

These new paints have aroused considerable interest among users because their use causes very little pollution of the environment. The invention is specifically directed towards solving the problems arising from the low resistivity of the new paints when used in electrostatic sprayers held at a high voltage and where the paint is supplied through the intermediary of long, closed loop, electrically grounded paint circulation circuits.

A conventional electrostatic spray painting installations as used in a production plant as large as an automobile manufacturing plant, for example, generally comprises a plurality of closed loop paint circulation circuits that are very long (these circuits may cross the whole of a part of the plant) and which establish the connection between large paint storage tanks and the various spray booths. It is therefore necessary to provide at least one such circuit per color and another circuit of the same kind for the solvent or dilutant. For obvious safety reasons these circuits are electrically grounded. For convenience they will be referred to as "primary circuits" in the remainder of the description.

In a spray painting booth the objects to be painted, which are automobile bodies in the example under discussion, are carried by conveyor means which pass through said booth and so past a plurality of electrostatic sprayers positioned at different levels and oriented in different directions, and often articulated to their respective supports, so as to paint respective areas of said objects. The size and shape of the objects (especially when they are automobile bodies) are such that at least nine projectors per painting station are normally required. The sprayers are normally offset longitudinally along the length of the conveyor means. However, those skilled in the art have always sought ways to achieve the least possible spacing between the sprayers as the organic solvent paints used until now dry relatively quickly. For the layers or areas of paint applied by different and spaced sprayers to merge in a satisfactory way it is necessary that the areas or layers applied successively remain sufficiently liquid to merge with each other.

Another problem where the introduction of the new paints is causing changes is that of changing the color. In the automobile industry in particular there is no question of painting long runs of automobile bodies the same color. To the contrary, it is usually the case that the color has to be changed for virtually every body. This means that it must be possible to execute extremely fast electrostatic sprayer rinsing and drying cycles. This is generally achieved without too much difficulty in the case of organic solvent paints. If the installation is designed in such a way that changing the color entails an operation to drain-rinse-dry a storage tank which receives paints of different colors, the color change sequence is necessarily slow and constitutes a serious obstable to the functioning of the system.

However, the most serious problem to be solved is that resulting from the low resistivity of the water-based paint itself. If the high-tension voltage is applied directly to the paint spraying member (a spray bowl rotating at very high speed, for example) the high-tension generator is then grounded through the paint itself since this has such a low resistivity that it establishes an electrical connection of negligible resistance as far as the primary circuit.

Various solutions have been proposed for solving or circumventing the problems stated hereinabove.

Thus it has been proposed to ground the sprayer and to apply a high-tension voltage to the objects to be coated. This is described, for example, in the document DEOS 3344703. The invention is not concerned with this type of solution which has major disadvantages and in particular that of making it necessary to maintain the object (an automobile body) at a high potential throughout the spraying time. Also, dust tends to be deposited on the object when it is held at the high-tension voltage.

Other solutions involve not applying the high-tension voltage to the spraying member in contact with the paint. Ionizing electrodes are instead provided near said spraying member. This is the case, for example, with the system described in French patent 1 574 988. The disadvantage of a system of this kind is that the particles of paint leave the spraying member (the rotating bowl) with an electrical charge which attracts them towards the ionizing electrodes. The ions emitted by these electrodes then have to attach themselves to the particles and change the sign of their electrical charge so that they can then move towards the object. It has been observed that certain particles do not have sufficient time for their electrical sign to change during their movement towards the electrodes so that they reach and pollute the latter, the effect of which is to render the insulative support of the electrodes electrically conductive and thus eventually to establish a conductive path between the high-tension supply and ground. Also, these problems sometimes result in the spraying onto the bodies of lumps of paint formed by an agglomeration of paint particles that have reached the electrodes.

The invention is not concerned with this category of solutions either, but attempts to retain the advantages of electrostatic charging of the paint by the spraying member raised directly to the high-tension voltage, that is to say usually by a spray bowl rotating at high speed.

In the same line of thinking it has previously been proposed to insert between the primary circuit and the sprayer storage tanks for "isolating" the electrical connection, that is to say to provide intermediate storage for the paint that can be raised to the high-tension voltage and insulated from ground. For example, U.S. Pat. No. 4,544,570 provides such isolation by atomizing the paint from the primary circuit in an intermediate receptacle. This solution introduces the risk of the paint being soiled or oxidized by the ambient air or thickened by partial evaporation of the water and co-solvents.

French patent 2 572 662 proposes to fill the intermediate storage tank with just the quantity of paint necessary for each application. This operation is conducted in such a way that the paint is protected from exposure to air. However, and as previously mentioned, each color change makes it necessary to clean out the intermediate storage tank and all the pipes connected to it. Also, isolation is re-established after filling by draining and drying a sufficient portion of the pipework on the upstream side of the intermediate storage tank. The time this takes on each color change is prohibitive. French patent 2 454 846 (and the corresponding U.S. patent application Ser. No. 032 790) proposes an arrangement comparable to that just described but requires, for each sprayer, as many intermediate storage tanks as there are colors. In an installation comprising a plurality of sprayers this teaching therefore results in a considerable increase in the number of intermediate storage tanks and thus in the cost of the installation.

The invention is aimed at eliminating all of the problems stated hereinabove and proposes a new arrangement requiring only one intermediate storage tank per color, irrespective of the number of sprayers, and also making it possible to minimize the time to change the color by virtue of a new arrangement of the sprayers relative to each other.

SUMMARY OF THE INVENTION

The invention consists in an electrostatic spraying installation for low-resistivity paint, comprising a conveyor adapted to convey like objects to be painted with a substantially constant distance between their respective leading edges, a plurality of sprayers positioned to paint respective specific parts of said objects as they are conveyed past said sprayers by said conveyor, a respective spray member in each sprayer adapted to be connected to a high-tension electrical supply, all said spray members being substantially situated in a common plane perpendicular to the path of movement of said objects along said conveyor or in a plurality of planes perpendicular to said path and spaced from each other by said substantially constant distance, a plurality of electrically grounded closed loop primary paint circulation circuits each adapted to contain paint of a respective color different than the color of the paint in each of the other primary circuits, a plurality of intermediate storage tanks electrically insulated from ground, equal in number to said primary circuits and each assigned to a respective primary circuit, means for selectively connecting each intermediate storage tank to the respective primary circuit, a plurality of selector valves adapted to connect each intermediate storage tank selectively to said sprayers, and control means adapted to operate said selective connection means or a subset thereof only when none of said spray members is connected to said high-tension supply.

The last-named feature means that the sprayers have at that time no objects to be painted in front of them. The leading edge of each consecutive object is defined relative to the direction of movement of the objects.

It will be understood that the case in which all the sprayers are grouped together in the vicinity of a common plane corresponds to the case where the objects to be painted are relatively compact. For the more difficult case of large objects, and especially automobile bodies necessitating a large number of sprayers, the latter will be grouped together in the vicinity of a plurality of planes (generally two or three) separated from each other by the above-defined "substantially constant distance". Water-based paints remain liquid longer than organic solvent paints, so the distance between the sprayers can be larger without compromising the "merging" of the layers or areas of paint.

It will be understood that with this arrangement all the sprayers are simultaneously in the painting mode or simultaneously in a state ready to undergo, where required, a cleaning and drying cycle (while they are between moving objects), without wasting time. The intermediate storage tanks no longer need to be insulated from each other and are topped up as necessary, each time that the sprayers have no object to paint in front of them, the high-tension voltage being then briefly lowered or disconnected from all the sprayers. Note that this makes the invention well-suited to simplification of the paint feed means since a single intermediate storage tank per color may be shared by all the sprayers.

The invention will be better understood and other advantages of the invention will emerge more clearly from the following description of one embodiment of an electrostatic paint spraying installation in accordance with the invention, given by way of example only and with reference to the appended diagrammatic drawings.

DESCRIPTION OF THE PREFERRED EMBODIMENT

Figure 1:
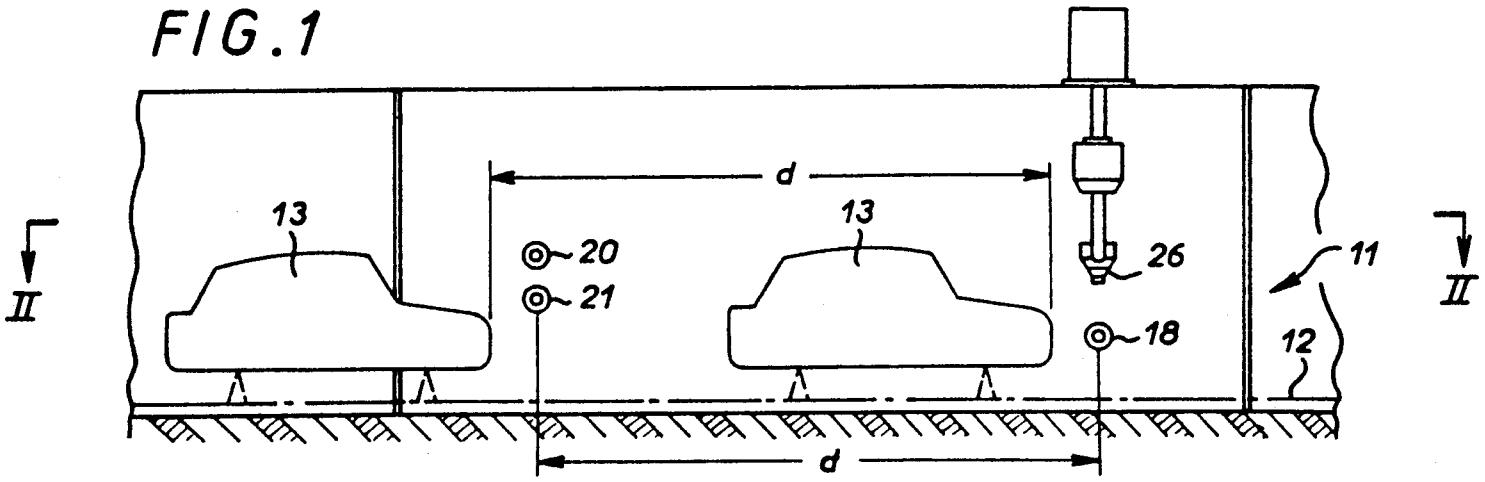
FIG. 1 shows in schematic elevation an electrostatic paint spraying booth in accordance with the invention associated with conveyor means transporting automobile bodies.
Figure 2:
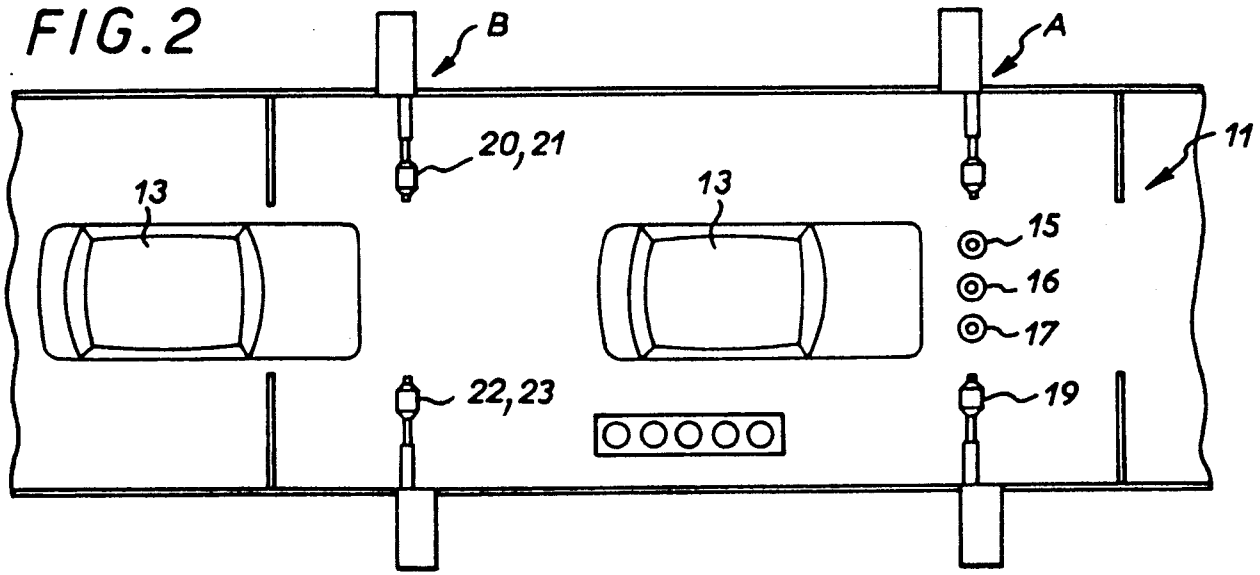
FIG. 2 is a plan view on the section line II—II in FIG. 1.

Referring specifically to FIGS. 1 and 2, there is shown an electrostatic spray painting booth 11 through which passes longitudinally at ground level conventional conveyor means 12 carrying objects to be painted spaced from each other. In this instance the objects 13 are automobile bodies. They are consequently somewhat large, to the point of requiring nine paint sprayers 15 through 23. Each sprayer comprises a spray member 26 such as, for example, a spray bowl rotating at very high speed, raised to the high-tension voltage.

The sprayers 15 through 17 are downwardly oriented to paint the upper parts of the body, the sprayers 18 and 19 are oriented horizontally and situated one on each side of the conveyor means to paint the lower side parts, and the sprayers 20 through 23 are oriented and situated in an analogous way to the sprayers 18 and 19 but so as to paint the upper side parts. In the conventional way the bodies 13 succeed one another on the conveyor means 12 and are regularly spaced in such a way that the leading edges of two consecutive bodies are separated by a substantially constant distance d. This feature is exploited by the invention.

According to one important characteristic of the invention the sprayers 15 through 23 are divided into two groups A and B, the sprayers in each of the two groups being all substantially situated in a respective plane at least approximately perpendicular to the path of movement of the bodies 13 and separated by approximately the above-defined distance d. Naturally enough, if the number of sprayers justified it, it would be possible to divide them into three or more groups, the sprayers being in each case arranged in planes separated by the same distance. On the other hand, if the size of the objects to be painted made it possible to situate all of the sprayers in the vicinity of a common plane, this arrangement, completed as described below, would still be within the scope of the invention. As emerges clearly from FIGS. 1 and 2, the aim is to arrange things such that all the sprayers can simultaneously be either in the painting mode or in the non-painting (and possibly color change) mode.

Figure 3:
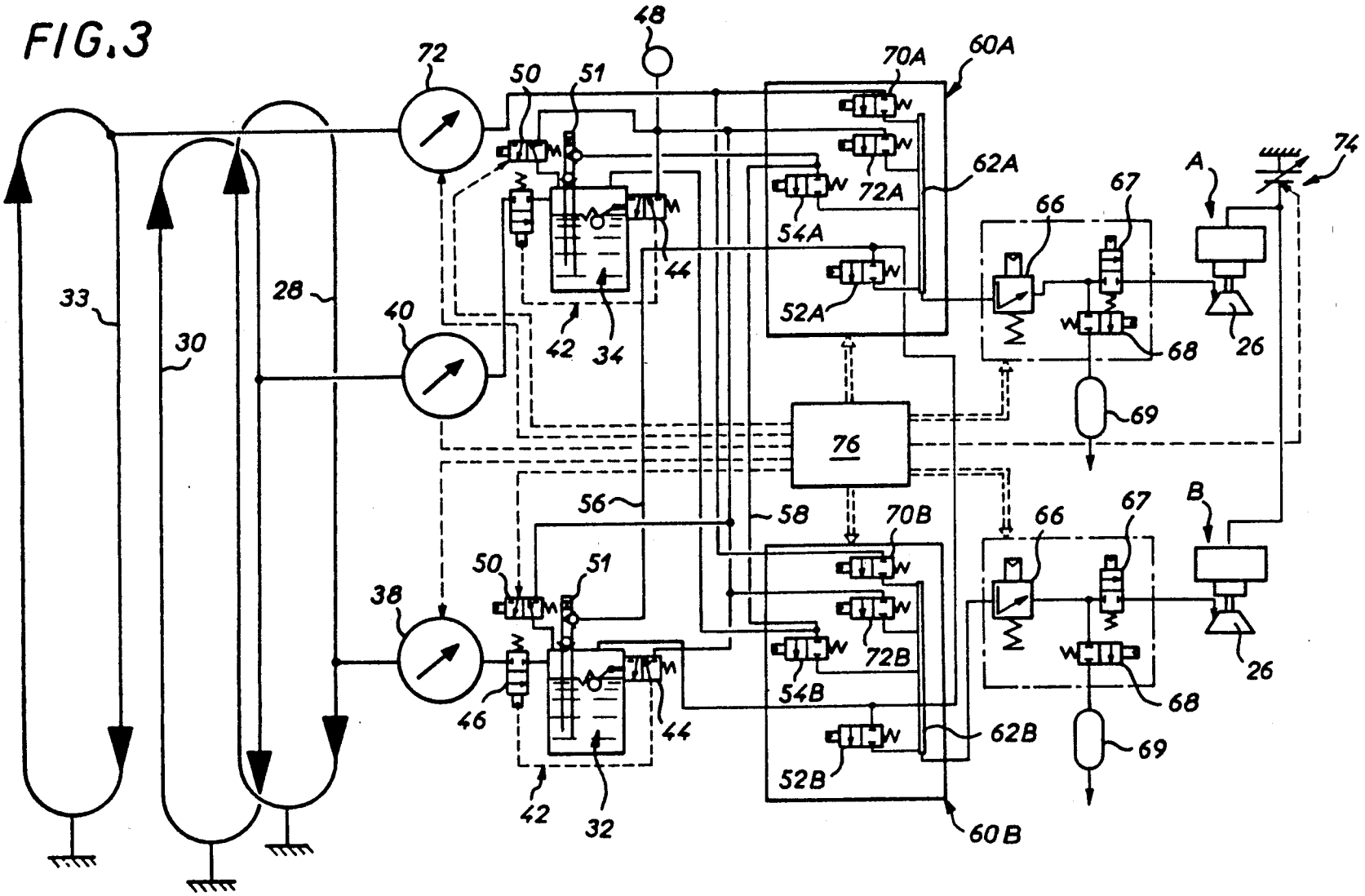
FIG. 3 is a block schematic of the system feeding paint to the booth in FIG. 1, simplified by showing only two sprayers (symbolically representing the two planes, for example) and only two different colors.

Referring to FIG. 3, there is schematically represented all of the system for feeding paint to two sprayers A and B symbolically representing, for example, all of the sprayers 15 through 19 of group A and all of the sprayers 20 through 23 of group B, as shown in FIGS. 1 and 2. The installation is also simplified in that it relates to the case of only two colors. The components or subsystems whose number depends on the number of sprayers or groups of sprayers and the components or subsystems whose number depends on the number of colors will be indicated later. In the example here described, there are thus only two closed loop primary paint circulation circuits 28, 30 (of the type defined hereinabove, that is to say electrically grounded) and one primary solvent circulation circuit 33 similar to the circuit 28, 30. There is only one primary solvent circuit. There are as many primary paint circuits as there are different colors.

The sprayers A, B can be connected by a set of valves to intermediate storage tanks 32, 34 electrically insulated from ground. There is one intermediate storage tank for each primary paint circuit, each storage tank corresponding to one circuit. Each storage tank 32, 34 is also connected to the corresponding primary circuit by respective selectively operable connection means 38, 40. In the example this is a known device forming a quick-release connector, as marketed under the trade name "STAUBLI", for example. A device of this kind, when it is disconnected by the operation of an automatic control system, has its male and female terminations sufficiently far apart for there to be total fluidic and especially electrical disconnection without any risk of electrical arcing.

Constant-level filling means comprising a level sensor 44 and a valve 46 controlled by the latter are associated with each intermediate storage tank. The valve 46 is inserted between the intermediate storage tank 32 or 34 and the corresponding primary circuit 28 or 30, in this instance downstream of the connecting means 38 or 40. To be more precise, the level sensor 44 is responsive to the level of paint in the corresponding intermediate storage tank and comprises a pneumatic part fed from a compressed air supply 48. The valve 46 is operated by a pneumatic circuit 42 controlled by the sensor. Topping up of the intermediate storage tank is therefore subject to the simultaneous existence of two conditions:

the connection means 38 or 40 must be connected, and the valve 46 must be open.

Each storage tank 32, 34 is hermetically sealed but can be vented to the atmosphere or pressurized through an electrically operated valve 50. One inlet of this valve is open to the atmosphere and the other is connected to the air supply 48. Thus the storage tank is normally pressurized except at times when paint is taken off from the primary circuit to top up the level in the intermediate storage tank. At this time the valve 50 is operated so that the storage tank is vented to the atmosphere.

Paint is taken up from the storage tank by a pump 51. Each storage tank 32, 34 is connected to all the sprayers A, B by respective selector valves 52A, 52B and 54A, 54B. To be more precise, the outlet from the pump 51 of each storage tank 32, 34 feeds into a respective closed loop secondary paint circulation circuit 56 or 58 returning to the same storage tank and connected to the inlets of the respective selector valves 52A, 52B or 54A, 54B to establish the connection to the various sprayers A, B.

Thus the valves 52A, 54A corresponding to sprayer A are grouped in one color change unit 60A while the valves 52B, 54B corresponding to sprayer B are grouped in another color change unit 60B. The outlets from the valves grouped together in a color change unit are connected to a manifold 62A or 62B connected to the corresponding sprayer A or B. Between the outlet from each color change unit and the sprayer are conventional subsystems such as a flowrate regulator 66, a shutoff valve 67 and a discharge valve 68 the outlet from which is connected to an electrically insulated recovery tank 69. The valves 67 and 68 are operated in the usual way during rinsing and color change cycles.

The primary solvent circulation circuit 33, which is also electrically grounded, is connected to the inlets of as many rinsing valves 70A, 70B as there are sprayers through the intermediary of selectively operable connection means 72 similar to the means 38, 40 described hereinabove. Each color change unit therefore comprises a rinsing valve with its outlet connected to the corresponding manifold 62A or 62B. If it were necessary to anticipate a color change cycle on certain sprayers before the end of the spraying period of other sprayers consideration could be given to adding an intermediate solvent storage tank exactly like the storage tanks 32, 34 and thus to defining a closed loop secondary solvent circulation circuit.

The compressed air supply 48 is connected to as many paint discharger-and-dryer valves 72A, 72B as there are sprayers, the outlets from these valves being connected to the respective manifolds 62A, 62B. Thus each color change unit comprises a paint discharger-and-dryer valve of this kind.

It should be noted that the invention makes it possible to use only one adjustable high-tension supply 74 common to all the sprayers. This is possible because all of the sprayers are in service at the same time. It is this solution which is shown. The high-tension supply 74 is conventional, its output being adjustable at any time between zero volts and a nominal voltage in the order of 120 kV.

The high-tension supply 74 and all the valves described hereinabove (except the valves 44) together with the connection means 38, 40 and 72 are controlled and synchronized by control means 76 which may be centralized at a control console, for example. Such control means may be implemented in very different electromechanical or electronic ways; they may be associated with a computer. Once the painting sequences have been defined, their design is within the competence of those skilled in the art and this is why they are not described in more detail. According to the invention, one characteristic of these control means is that they are adapted (programmed) to operate the connection means 38, 40 or 72 (or a subset thereof) only after the output voltage of the high-tension supply 74 has been reduced to zero volts or an acceptable residual voltage.

The installation operates as follows:

The intermediate storage tanks 32, 34 are filled with paint of different colors from the respective primary circuits 28, 30 and the pumps 51 procure continuous circulation of paint in the secondary circuits 56, 58. In each color change unit 60A, 60B paint of a different color is therefore fed to the fluid inlets of the selector valves 52A, 52B, 54A, 54B. Note that on the upstream side of the sprayers the paint is never atomized or sprayed by jet or gravity means from one storage tank to another in a free atmosphere. This avoids any evaporation or deterioration of the paint, which therefore retains its original properties. Solvent from the primary circuit 33 is also fed to the fluid inlets of the valves 70A, 70B while compressed air is fed to the fluid inlets of the valves 72A, 72B.

When one (or two) colors is (or are) selected and two consecutive bodies pass in front of the sprayers A and B the control means 76 open the corresponding valves 52 or 54 and the output voltage of the high-tension supply is raised to its nominal value. Throughout the time during which the bodies pass in front of the sprayers or groups of sprayers A and B the connection means 38, 40 and 72 are electrically and hydraulically "open", meaning that the connection to the primary circuits is cut off.

As soon as the bodies move out of the field of the sprayers A and B the control means 76 sends a succession of control signals in order to:

rapidly reduce the output voltage of the high-tension generator to zero volts, close the selector valves 52 and/or 54 which were open, and close the connection means 38, 40 and possibly 72 if a color change cycle is needed.

From this time the intermediate storage tanks 32, 34 (which were previously pressurized by air from the compressed air supply 48 through the intermediary of the valves 50) are vented to the atmosphere by changing the state of the valves 50 and the storage tank or tanks whose valves 46 were preselected by the level sensor 44 are topped up during the time when there are no bodies in front of the sprayers. It is also during this time interval that the color change cycles are executed if necessary, that is to say if the bodies coming next are not programmed to be the same color. A color change cycle entails the sequential operation of the valves 67, 68, 70 and 72 concerned and, being conventional, is not described in detail. The color change units 60A or 60B are then programmed with different colors at the time the sprayers return to service by operation of the corresponding valves 52 or 54. Before the sprayers return to service the connection means 38, 40 and possibly 72 are again open (disconnected) before the output voltage of the high-tension supply 74 is again raised.

I claim:

1. An electrostatic spraying installation for low resistivity water based paints comprising:

(a) a plurality of electrically grounded primary paint circulation circuits each adapted to contain paint of a respective color;

(b) a plurality of intermediate storage tanks electrically insulated from ground, equal in number to said primary circuits and each assigned to a respective primary circuit;

(c) operable insulating duct means inserted between each intermediate storage tank and its respective primary circuit;

(d) a conveyor adapted to convey spaced like large objects at least substantially of the size of an automobile body, said objects to be painted being regularly spaced to provide for a substantially constant distance between their respective leading edges;

(e) a plurality of electrostatic sprayers comprising respective spray members connected to adjustable high voltage means, said sprayers being positioned to paint respective specific parts of said objects as they are displaced by said conveyor, and being separated into groups respectively substantially situated in the vicinity of a number of planes perpendicular to the path of movement of said objects, said planes being spaced from each other by said substantially constant distance;

(f) a number of paint change units equal to said number of planes, each unit having one outlet connected to feed sprayers of a corresponding said group and having several controlled inlet means respectively connected to said intermediate storage tanks; and (g) control means for controlling operations of said high voltage means, said insulating duct means and said paint change units, said control means being adapted to at least substantially lower said high voltage means and then to operate at least a subset of said insulating duct means and to operate said paint change units simultaneously, only and as soon as said spray members of all the sprayers of all groups are simultaneously facing spaces between said like objects.

2. Installation according to claim 1 wherein each intermediate storage tank comprises filling means including a level sensor and a valve controlled by said level sensor connected between said tank and the respective selective connection means.

3. Installation according to claim 1 further comprising a respective closed loop secondary paint circulation circuit between each intermediate storage tank and said paint change units.

4. Installation according to claim 1 wherein each said paint change unit includes the same number of selector valves as there are intermediate storage tanks and a manifold connecting the outlets of said selector valves to a respective group of sprayers.

5. Installation according to claim 4 further comprising an electrically grounded primary solvent circulation circuit, a rinsing valve in each paint change unit connected to the corresponding manifold and means for selectively connecting said solvent circuit to said rising valve when voltage from said high voltage means is at least substantially lowered.

6. Installation according to claim 4 further comprising air feed means and a discharger-and-dryer valve in each paint change unit connected between the corresponding manifold and said air feed means.

7. Installation according to claim 1 wherein said high voltage means is one voltage source common for all spray members of the sprayers of all said groups. u

* * * * *